US006719569B2

(12) United States Patent
Ochiai

(10) Patent No.: US 6,719,569 B2
(45) Date of Patent: Apr. 13, 2004

(54) CONTACT SHEET FOR PROVIDING AN ELECTRICAL CONNECTION BETWEEN A PLURALITY OF ELECTRONIC DEVICES

(75) Inventor: Toshimasa Ochiai, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 10/255,489

(22) Filed: Sep. 26, 2002

(65) Prior Publication Data

US 2003/0064635 A1 Apr. 3, 2003

(30) Foreign Application Priority Data

| | | |
|---|---|---|
| Oct. 2, 2001 | (JP) | 2001-306874 |
| Jan. 30, 2002 | (JP) | 2002-022440 |
| Jul. 16, 2002 | (JP) | 2002-207367 |

(51) Int. Cl.[7] ..... H01R 9/09
(52) U.S. Cl. ..... 439/66
(58) Field of Search ..... 439/66, 67, 70, 439/71, 91, 862

(56) References Cited

U.S. PATENT DOCUMENTS

| | | | | |
|---|---|---|---|---|
| 3,862,790 A | | 1/1975 | Davies et al. | |
| 4,295,700 A | | 10/1981 | Sado | |
| 5,578,870 A | | 11/1996 | Farnsworth et al. | |
| 5,637,008 A | | 6/1997 | Kozel | |
| 5,702,255 A | | 12/1997 | Murphy et al. | |
| 5,730,606 A | | 3/1998 | Sinclair | |
| 6,293,808 B1 | * | 9/2001 | Ochiai | 439/70 |
| 6,305,948 B1 | * | 10/2001 | Wu | 439/66 |
| 6,488,513 B1 | * | 12/2002 | Neidich et al. | 439/66 |

FOREIGN PATENT DOCUMENTS

| | | |
|---|---|---|
| JP | 6-82521 | 3/1994 |
| JP | 9-21847 | 1/1997 |

* cited by examiner

*Primary Examiner*—Javaid H. Nasri
*Assistant Examiner*—Thanh-Tam Le
(74) *Attorney, Agent, or Firm*—Burr & Brown

(57) ABSTRACT

A contact sheet for providing an electrical connection between two or more electronic devices each having spherical or planar terminals is provided. The contact sheet includes a plurality of insulative elastic substrate sheets having a plurality of through holes formed therethrough and a plurality of conductive elastic contacts each having a first end interposed and fixed between two of the insulative elastic substrate sheets at a fixed point proximate an edge of a respective through hole, and a second end arranged to bend as a cantilever extending from the fixed point. Each contact also includes a centrally located bending portion. The width of the contact continuously varies to be greater at portions of the contact which are subjected to larger stresses and less at positions of the contact which are subjected to smaller stresses when a load is applied to the second end of the contact.

21 Claims, 9 Drawing Sheets

(a)

(b)

CONTACT SHEET FOR PROVIDING AN ELECTRICAL CONNECTION BETWEEN A PLURALITY OF ELECTRONIC DEVICES

This application claims the benefit of Japanese Applications 2001-306874, 2002-022440, and 2002-207367, filed Oct. 2, 2001, Jan. 30, 2002, and Jul. 16, 2002, respectively, the entireties of which are incorporated herein by reference.

FIELD OF THE INVENTION

The present invention relates to a contact sheet. More specifically, the invention relates to a contact sheet which provides an electrical connection between electronic devices (such as integrated circuits, cables, and printed circuit boards) with a low spring load while accommodating variations in the size of the electronic devices. The contact sheet is suitably used for various tests or for mounting electronic devices, has excellent durability and reliability over repeated or long-term use, and also facilitates a ZIF (zero insertion force) structure for electronic devices having spherical terminals.

BACKGROUND OF THE INVENTION

In recent years, because of the demands for reduced sizes and higher speeds in the field of information processing equipment, the lead pitch in electronic devices, such as integrated circuits, is increasingly becoming finer. From this viewpoint, the mounting method is shifting from through-hole mounting to surface mounting, and the arrangement of terminals is shifting from a peripheral arrangement to grid arrays. As a result, ball grid array (BGA) devices and land grid array (LGA) devices are becoming the mainstream mounting features since they permit surface mounting, even for grid arrays.

Sockets or connectors are more often employed to provide an electrical connection between electronic devices in place of soldering because of the demand for a lead-free connection. Such a socket or a connector is used, for example, not only to test an integrated circuit, but also for replaceably mounting electronic devices to printed circuit boards.

In recent years, the increasing operating speed of electronic devices, such as MPUs or memories, requires such devices to have lower inductance and less self-heating at higher-speed clock operation. To meet these requirements, the contact structure of the connector placed between terminals of electronic devices, integrated circuits or boards, must reduce the distance over which currents pass and reduce the electrical resistance as much as possible. Furthermore, since the spread of mobile electronic equipment calls for electronic devices having a thinner shape, the connectors which are mounted in the above devices also are required to have a thinner shape. Therefore, a contact sheet which meets the demands for minimizing current pass and which has a thin shape, as mentioned above, is promising as a thin connector with a fine pitch.

Meanwhile, as a thin connector with a fine pitch, as well as the contact sheet above, a component called "an anisotropic conductive sheet" has conventionally been used. For example, conductive sheets having conductive elastomers or metal wires arranged in an insulative elastomer are known (U.S. Pat. Nos. 3,862,790 and 4,295,700) as well as ones in which conductive particles are added (Japanese Unexamined Patent Publication No. 6-82521).

Furthermore, contacts with a structure for avoiding contact with ball tips while tearing oxide films on solder surfaces are known, such as one having Y-shaped contacts (Japanese Unexamined Patent Publication No. 9-21847), and one which is inserted in finger springs (U.S. Pat. Nos. 5,702,255 and 5,730,606).

Additionally, the more terminals an integrated circuit has, the more insertion force that is required. A contact sheet having a structure in which the foregoing force is reduced to zero, and where spherical terminals are pushed laterally later by using a lever or the like is also known (U.S. Pat. Nos. 5,578,870 and 5,637,008).

However, problems with anisotropic conductive sheets exist. If the mounted electronic device is warped, the displacement length of the spring portion in the conductive sheet is too short to compensate for the warp. In addition, if the mounted electronic device has many terminals, the excessive contact load required to obtain an electrical connection causes the electronic device to deform. Also, when the electronic device adopts a BGA, there are problems in that the oxide film on the solder surface is not torn, and the peak of the solder ball is easily crushed while connecting.

On the other hand, even though an electrical connection can be ensured with Y-shaped contacts, since a long cantilever is employed, the distance over which currents must pass is relatively long. When Y-shaped contacts are used as contacts for testing or mounting at high frequency, the inductance against high-speed clock operation or resistance increases and heat is generated. It is difficult, however, to reduce the length of such Y-shaped contacts.

SUMMARY OF THE INVENTION

The present invention has been made with a view toward solving the above problems, and an object thereof is to provide a contact sheet that enables reliable electrical contact between electronic devices under low spring load while accommodating variations in the size of the electronic devices, such as an integrated circuit, a cable, and a printed circuit board. The contact sheet is suitably used for various tests or for mounting an electronic device, has excellent durability and reliability over repeated and long-term use, and also facilitates a ZIF (zero insertion force) structure for an electronic device with spherical terminals.

In order to attain the above-mentioned purpose, as a result of extensive research, applicants discovered that changing the width of a cantilever contact according to the distribution of stress in the contact provides a sufficient contact load, sufficient displacement, superior durability, and reliability. That is, the contact sheet has good characteristics including a high resistance to permanent plastic deformation and provides a high quality connection without variation because plastic deformation does not occur in a contacting part of the contact after plating.

That is, the present invention provides a contact sheet for providing an electrical connection between two or more electronic devices having spherical terminals or planar terminals, comprising two insulative elastic substrate sheets having a plurality of through holes and a plurality of plate-shaped or wire-shaped conductive elastic contacts. One end of one side of each contact is inserted and fixed between two of the substrate sheets at one edge (fixed point) of a through hole, while the other end of the contact is a moveable, non-fixed end arranged to bend as a cantilever extending from the fixed point, such that it departs only a predetermined distance from a first surface of the contact sheet with respect to the fixed point when a load is added to the non-fixed end. The contact has a bending portion in roughly a central part of the length (long direction) of the contact, where the contact is bent to extend in an angular direction such that the non-fixed end is positioned at a predetermined distance from the surface of the contact sheet, and the width of the contact, which is substantially perpendicular to the length, is continuously varied to be wider at areas of the contact which are subjected to larger stress and narrower at areas of the contact which are subjected to smaller stress, according to the quantity of stress applied to each part of the contact when a load is applied to the non-fixed end.

When an electronic device is mounted on an outer (first) side of the contact sheet, a spherical terminal or a planar terminal of the electronic device applies a load to the non-fixed end of the contact, and the non-fixed end of the contact is pressed and wipes the surface of the spherical terminal or the planar terminal of the electronic device. Consequently, an electrical connection can be ensured between the contact and the electronic device. At the same time, the bending portion of the contact is warped by the stress applied thereto, and the bending portion is pressed against another electronic device mounted on a second side of the contact sheet, to ensure an electrical connection between the bending portion of the contact and the other electronic device. In that manner, two or more electronic devices are electrically connected to each other via the contact sheet of the present invention.

According to the present invention, the contact sheet includes a second surface, and the bending portion of the contact protrudes from the second surface of the contact sheet. The electronic devices connected to each other via the contact sheet of the present invention include one or more devices selected from the group consisting of integrated circuits, electronic parts, cables, printed circuit boards, connectors, microphones, motors, antennas, and speakers.

The contact sheet according to the present invention can be used when the spherical terminals or the planar terminals of the electronic devices are arranged in a grid pattern, by providing the contacts arranged in the same grid pattern.

According to the present invention, the width of the contact is preferably widest at the bending portion, and decreases gradually to be continuously narrower toward the non-fixed end from the bending portion, and is narrowest at the non-fixed end. Furthermore, the width decreases gradually to be continuously narrower from the bending portion to an intermediate portion of the contact between the bending portion and the fixed end, and the width then increases gradually to be continuously wider from the intermediate portion to the fixed end.

The contact of the present invention can have a V-shaped or U-shaped notch opening toward the non-fixed end which is positioned between the non-fixed end and a predetermined portion of the contact between the non-fixed end and the bending portion. The contact can also include a slit in the shape of a convex lens positioned at a predetermined portion of the contact between the fixed end and the bending portion.

The contact can also be formed to have a peripheral outline in the shape of a concave lens over a portion of the length of the contact between the fixed end and a predetermined portion of the contact between the fixed end and the bending portion.

The fixed end of the contact is preferably wider than the bending portion, and a portion of the fixed end can extend back toward the non-fixed end. The portion of the fixed end that extends back toward the non-fixed end can extend to a position near the center point of the overall length of the contact.

The non-fixed end of the contact can be separated into two cantilevers, each of which has a protrusion which is bent at an angle in a range of 20 to 90 degrees toward the planar terminal of an electronic device that the cantilever faces. The outer edge of the protrusion wipes the surface of the planar terminal of the electronic device, such that the contact and the electronic device can be securely electrically connected at the point where the contact resistance between the contact and the electronic device is reduced.

The bending portion of the contact can include one or more bumps facing the electronic device at a part of the bending portion where the electronic device is pressed, such that an outer edge of a bump presses on the electronic device, and the contact and the electronic device can be securely electrically connected at the point where the contact resistance between the contact and the electronic device is reduced.

Preferably, the contact has an effective length which can increase the amount of bending (displacement length) of the non-fixed end when a load is added to the non-fixed end of the contact, which acts as a cantilever extending from a fixed point (the fixed end of the contact).

The contact is preferably shaped to increase the amount of bending from the fixed end to the bending portion and reduce the amount of bending from the bending portion to the non-fixed end when a load is added to the non-fixed end of the contact.

According to one embodiment of the present invention, a complex of contact sheets is provided, wherein a plurality of contact sheets are bonded together via an adhesive sheet having through holes formed therethrough in the same pattern as that of the contact sheets. The contact sheets can be bonded directly via the adhesive sheet, and one of the substrate sheets of each of the contact sheets which would otherwise face the adhesive sheet can be removed or omitted such that the adhesive sheet directly adheres to each of the contacts. The adhesive sheet can be an anisotropic conductive film. A complex of contact sheets can also be provided, wherein a plurality of contact sheets are bonded via glue or soldering. One of the substrate sheets of each contact sheet can be removed or omitted such that the glue or soldering directly adheres to each of the contacts.

BRIEF DESCRIPTION OF THE DRAWINGS

FIG. 6(*a*) shows a state before mounting, and FIG. 6(*b*) shows a state after mounting.

FIG. 7(*a*) shows a state before mounting, and FIG. 7(*b*) shows a state after mounting.

FIG. 8(*a*) shows a state before an integrated circuit is mounted, and FIG. 8(*b*) shows a state after mounting the integrated circuit.

FIG. 9(*a*) shows a state before mounting, and FIG. 9(*b*) shows a state after mounting.

FIG. 10(*a*) shows a state before mounting, and FIG. 10(*b*) shows a state after mounting.

DETAILED DESCRIPTION OF THE INVENTION

Figure 1:
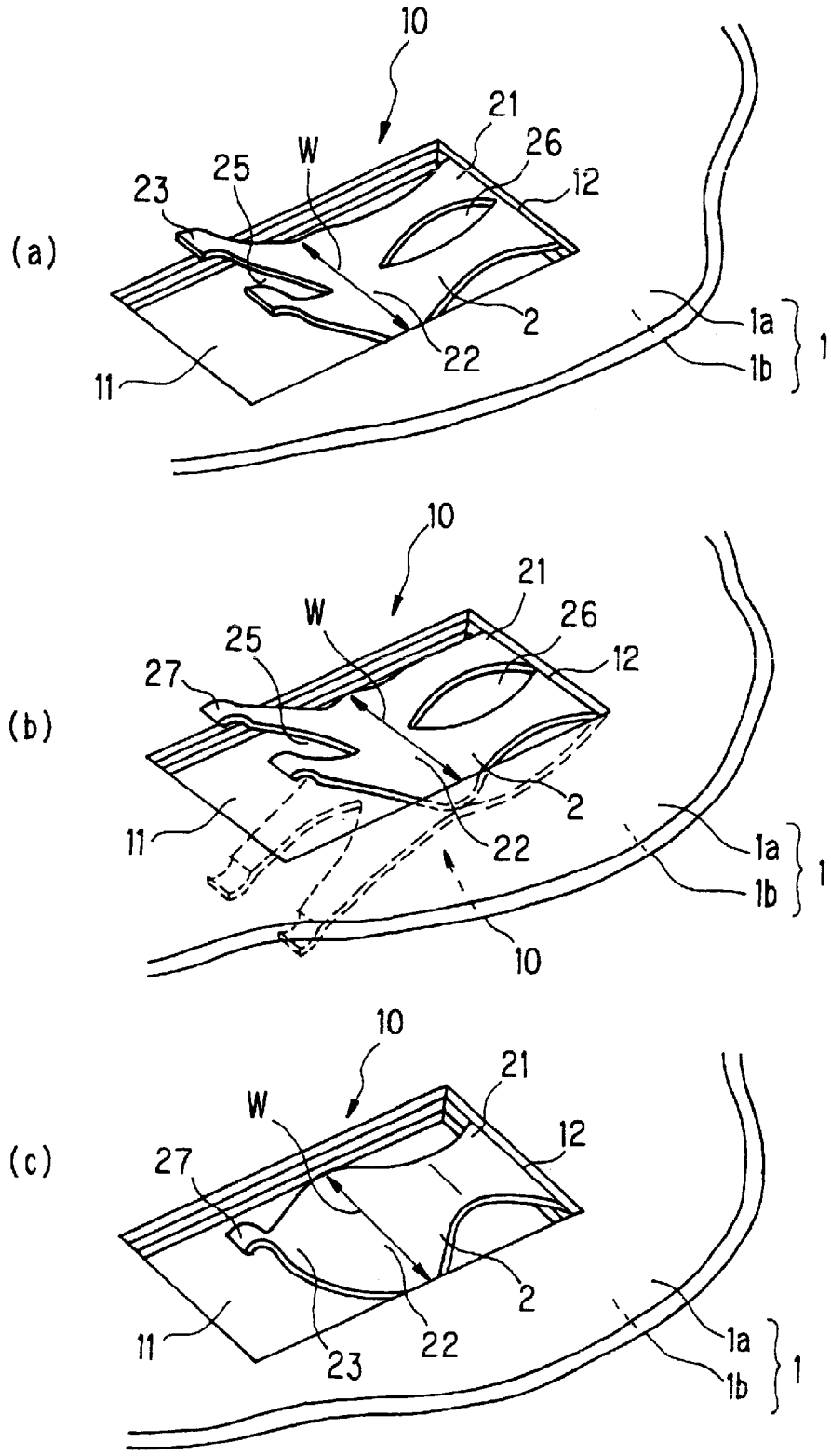
FIGS. 1(*a*), (*b*) and (*c*) are perspective views showing a preferred embodiment in accordance with the present invention, which illustrate the case for spherical terminals, for spherical or planar terminals with double displacement and for planar terminals, respectively.

As shown in FIGS. 1(*a*)–(*c*), a contact sheet 10 in accordance with the prevent invention provides an electrical connection between two or more electronic devices having spherical terminals or planar terminals. The contact sheet comprises an insulative elastic substrate sheet 1 having a plurality of through holes 11 formed therethrough and a plurality of plate-shaped or wire-shaped conductive elastic contacts 2. The fixed end 21 of the contact 2 is inserted and fixed between two of the substrate sheets 1 at one edge 12 (fixed point) of the through hole 11 of the substrate sheet 1. Meanwhile, the non-fixed end 23 of the contact 2 is arranged to bend in a direction such that the non-fixed end 23 departs only a predetermined distance from the surface of substrate sheet 1*a* with respect to the fixed point 12, when a load is added to the non-fixed end 23, to act as a cantilever extending from the fixed point 12. The contact 2 has a bending portion 22 positioned roughly at a central portion of its length (long direction) where the contact 2 is bent in a direction to further extend the distance between the non-fixed end 23 and the surface of the substrate sheet 1*a*. The width of the contact is measured in a direction perpendicular to the length (long direction) of the contact 2, and the width is continuously varied to be wider at portions of the contact 2 which are subjected to larger stress and narrower at portions of the contact 2 which are subjected to smaller stress, according to the quantity of the stress at each part of the contact 2 when a load is applied to the non-fixed end 23.

When an electronic device (not shown here) is mounted on an outer (first) side of the substrate sheet 1*a*, the spherical or planar terminal of the electronic device applies a load to the non-fixed end 23 of the contact 2. The non-fixed end 23 of the contact 2 is pressed and wipes or cuts the surface (which may have become oxidized) of the spherical terminal or the planar terminal of the electronic device. Consequently, an electrical connection can be ensured between the contact 2 and the electronic device. At the same time, the bending portion 22 of the contact 2 is warped by the stress applied at the bending portion 22, and the bending portion 22 is pressed against another electronic device (which is not shown here) mounted at the other side of substrate sheets 1*b* to make a secure electrical connection between the contact 2 and the other electronic device. In that manner, two or more electronic devices can be connected to each other electrically via the contact sheet of the present invention.

In FIGS. 1(*a*), (*b*) and (*c*) above, the contact sheets are applied in the case for spherical terminals, for spherical or planar terminals with double displacement, and for planar terminals, respectively. The main distinction between the contacts shown in FIGS. 1(*a*)–(*c*) is as follows.

(1) A contact point 27 having a curved surface is formed at the non-fixed end of the contact 2 shown in FIGS. 1(*b*) and (*c*) to prevent the surface of the planar terminal from being damaged, as explained later.

(2) The contact 2 shown in FIGS. 1(*a*) and (*b*) includes a slit 26 in the shape of a convex lens, the width of the non-fixed end 23 is narrowed, as explained later, and a V-shaped or U-shaped notch 25 opens toward the non-fixed end 23 in order to set out the solder ball and contact the inner edge of the contact to the solder ball.

(3) In the contact shown in FIG. 1(*c*), the width of the non-fixed end 23 is narrowed gradually without a V-shaped or U-shaped notch, and a slit 25 in the shape of a convex lens is not included.

(4) In FIG. 1(*b*), two contacts are arranged back to back to double the displacement.

In the contact sheet 10 in accordance with the prevent invention, the shape of the through holes 11 may be rectangular, triangular, circular, elliptical or any other shape, although rectangular is preferable. In addition, when the through holes 11 are rectangular, the dimensions preferably range from 0.2 to 1.5 mm by 0.4 to 3.0 mm. If the dimensions are less than 0.2 by 0.4 mm, manufacturing is difficult; if the dimensions exceed 1.5 by 3.0 mm, a fine pitch of contacts in the contact sheet cannot be achieved. When the through holes are circular, the diameter preferably ranges from 0.3 to 1.5 mm for the same reasons as mentioned above with respect to the rectangular shape.

Further, the pitch of the through holes 11 in the longitudinal direction preferably ranges from 0.55 to 4.0 mm. If the pitch is less than 0.55 mm, then sufficient assembly accuracy cannot be secured; if the pitch exceeds 4.0 mm, then the advantages of an integrated circuit will not be provided.

Figure 2:
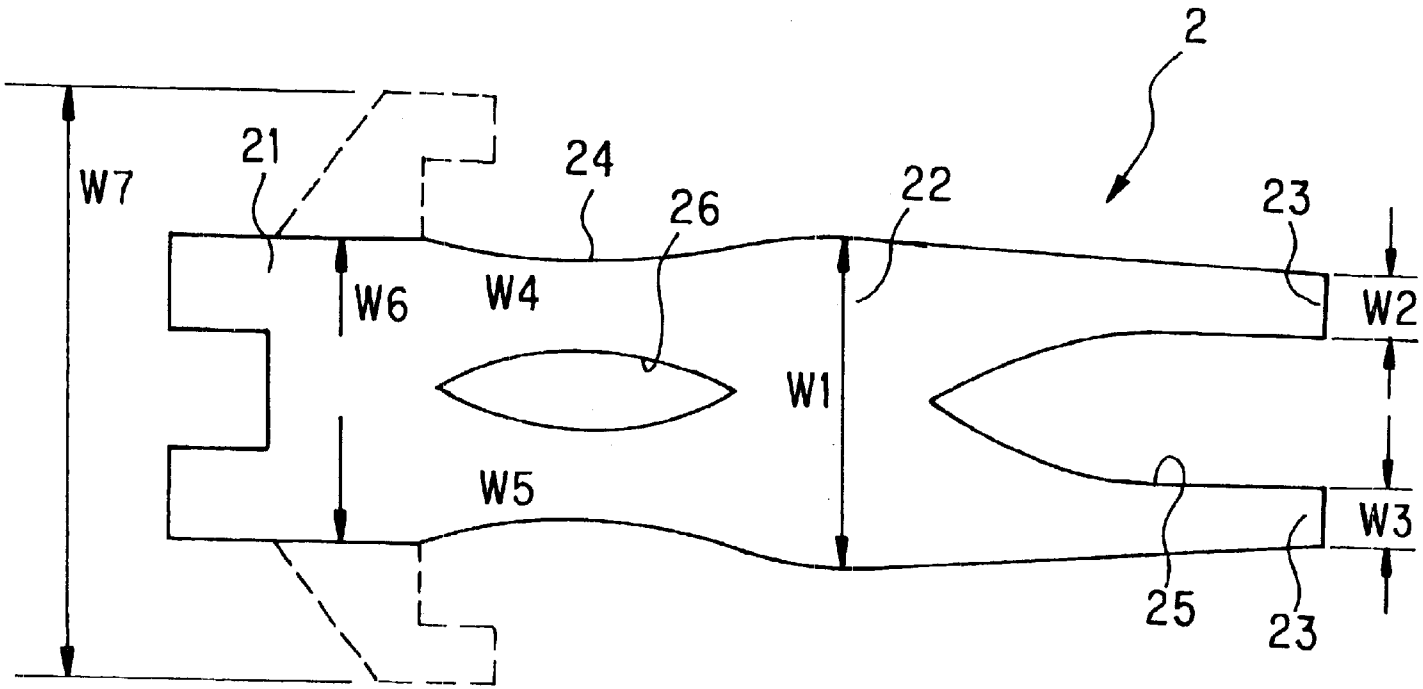
FIG. 2 is a top plan view showing the relation of the width of the contact in the first example.

FIG. 2 is a top plan view showing the relation of the width of the contact 2 in the first example. As shown in FIG. 2, the width of the contact 2 is widest (W1) at the bending portion 22, and decreases gradually to be continuously narrower from the bending portion 22 toward the non-fixed end 23, and is narrowest (W2+W3) at the non-fixed end 23. Furthermore, the width of the contact 2 decreases gradually to be continuously narrower from the bending portion 22 to the intermediate portion 24 between the bending portion 22 and the fixed end 21, where the width is W4+W5, and the width then increases gradually to be continuously wider from the intermediate portion 24 to the fixed end 21, where the width is W6.

The contact 2 preferably includes a V-shaped or U-shaped notch 25 opening toward the non-fixed end 23 which is positioned between the non-fixed end 23 and a predetermined portion of the contact 2 between the non-fixed end 23 and the bending portion 22.

Further, to increase the contact's resistance to twisting, it is preferred to include a slit 26 in the shape of a convex lens between the fixed end 21 and a predetermined portion of the contact between the fixed end 21 and the bending portion 22.

Moreover, the peripheral edge of the contact 2 is preferably shaped to have an outline in the shape of a concave lens over a portion of its length spanning from the fixed end 21 to a predetermined portion between the fixed end 21 and the bending portion 22.

In addition, as shown by the dashed line shown in FIG. 2, the width of the fixed end 21 (W7) of the contact 2 may be wider than that of the bending portion 22 (W1), and part of the fixed end 21 may extend back toward the non-fixed end 23.

Furthermore, there is no particular restriction as to how to bend the bending portion 22 as long as the contact 2 provides sufficient displacement of the non-fixed end 23 and sufficient resistance to permanent plastic deformation, and the inner edges of the above-mentioned V-shaped or U-shaped notch 25 of contact 2 can scratch off the oxide film on the spherical terminals of an electronic device (mentioned later). For example, the contact 2 may be bent at one place, or gradually at two or more places, or the contact 2 may be bent continuously in an arc. Moreover, the contact 2 is usually plate-shaped, but it may be wire-shaped.

The configuration mentioned above makes it possible to provide a contact having a width that varies according to the distribution of the stress applied thereon when an electronic device, such as an integrated circuit, is mounted. A contact sheet which satisfies all of the requirements for providing a sufficient contact load, sufficient displacement, superior durability, and high resistance to permanent plastic deformation is thus provided.

Figure 3:
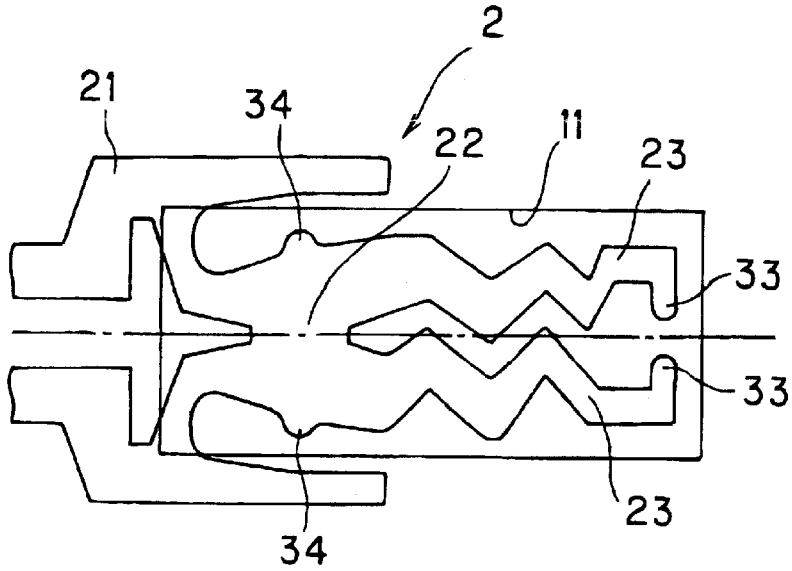
FIG. 3 is a top plan view showing the other example of the contact used for the contact sheet in accordance with the present invention.
Figure 4:
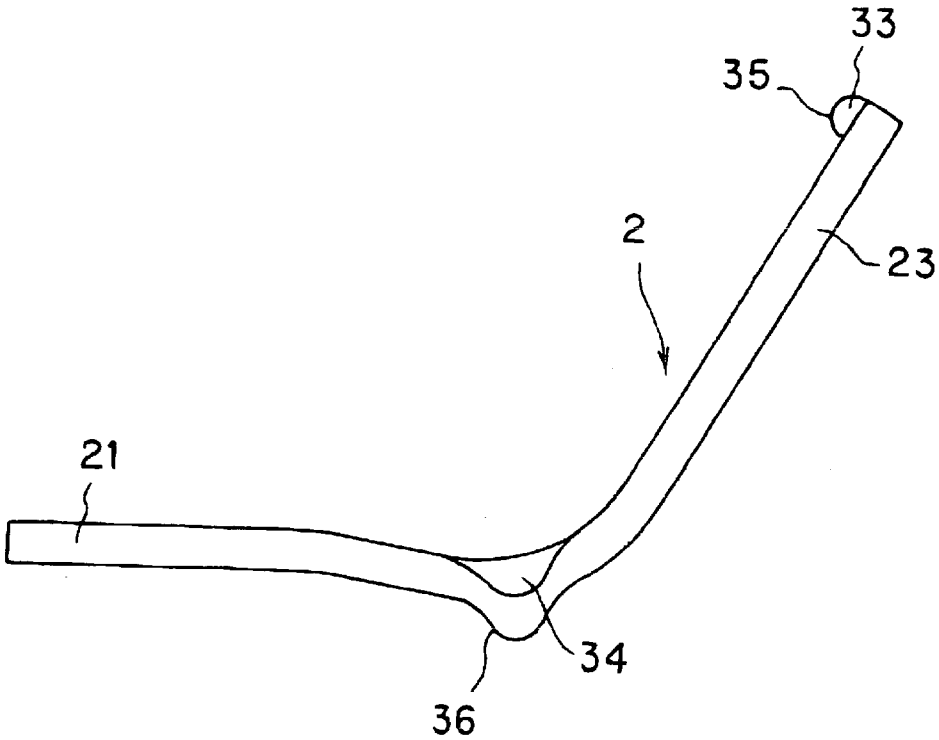
FIG. 4 is a side view of FIG. 3.

FIG. 3 is a top plan view showing another embodiment of the contact used for the contact sheet in accordance with the present invention. FIG. 4 is a side view of FIG. 3.

As shown in FIG. 3, preferably, a portion of the fixed end 21 of the contact sheet 2 extends back toward the non-fixed end 23, and more preferably, this portion extends back to almost the mid-point of the overall length of the contact 2.

In this manner, a portion of the fixed end 21 is inserted and fixed between two substrate sheets (not shown) over a sufficient area, and consequently, the mechanical strength and stiffness of the contact 2 can be increased. In this case, the longer the fixed end 21 extends back, the greater the effect. If the portion of the fixed end 21 extends back beyond the lengthwise midpoint of contact 2, however, the possibility exists that the portion of the fixed end 21 will interfere with the non-fixed 23 of the contact 2.

Moreover, as shown in FIG. 3 and FIG. 4, the non-fixed end 23 of the contact is separated into two cantilevers, each of which has a protrusion 33 which is bent at an angle in a range of 20 to 90 degrees, preferably 30 to 60 degrees, more preferably 40 to 60 degrees, toward the planar terminal (not shown) of an electronic device that the cantilever faces. It is preferable that the outer edge 35 of the protrusion 33 wipes the surface of the planar terminal of the electronic devices so that the contact 2 and the electronic device can be securely electrically connected at that point, since the contact resistance between the contact 2 and the electronic device is reduced by the wiping action (i.e., any oxide film that may have formed on the planar terminal can be removed).

Moreover preferably, the bending portion 22 of the contact includes bumps 34 which protrude toward the electronic device, positioned on a portion of the bending portion 22 where the electronic device is pressed. This provides a secure electrical connection between the contact 2 and the electronic device because contact resistance is reduced where the outer edge 36 of bump 34 presses against the electronic devices.

Furthermore, the contact 2 preferably has an effective length which increases the amount of bending (displacement length) of the non-fixed end 23 when a load is added to the non-fixed end 23 of the contact 2, to act as a cantilever extending from the fixed end 21.

Figure 5:
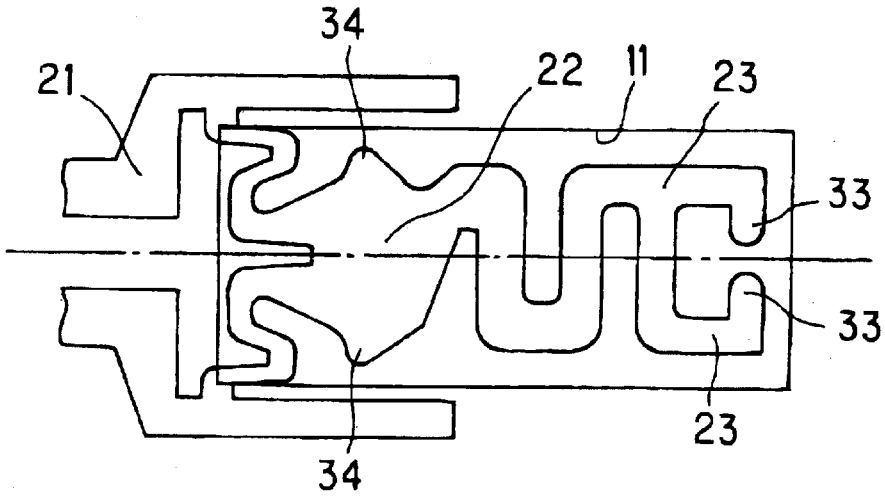
FIGS. 5(*a*) and (*b*) are top plan views showing other examples of a contact. The example shown in FIG. 5(*a*) has an effective length such that the amount of bending (displacement length) can be increased. The example shown in FIG. 5(*b*) has a shape which increases the amount of bending from the fixed end to the bending portion and decreases the amount of bending from the bending portion to the non-fixed end.
Figure 5:
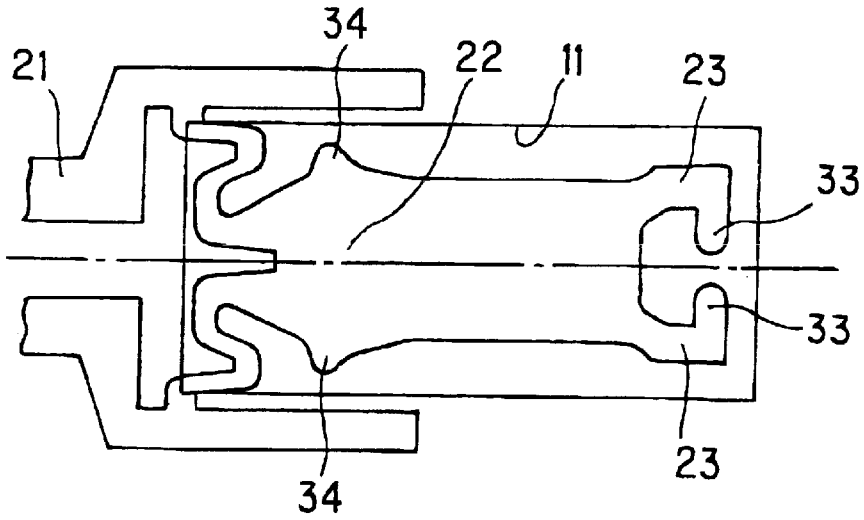

In FIG. 3, a contact having two non-fixed ends 23 which extend from the fixed end 21 in zigzag form is shown as an example of a contact 2 having an effective length which increases the amount of bending (displacement length). The contact shown in FIG. 5(*a*) may be also available. Moreover, if sufficient displacement is securable, the contact shown in FIG. 5(*b*), having a sufficient width to effectively reduce the electrical resistance through the contact, is preferred. The contact has a shape which increases the amount of bending from the fixed end 21 to the bending portion 22 and which decreases the amount of bending from the bending portion 22 to the non-fixed ends 23 when a load is added to the non-fixed ends 23 of the contact, to act as a cantilever extended from the fixed end 21.

Any materials that have sufficient strength, conductivity, wear resistance, flexibility, and oxidization resistance are suitable for the contact of the present invention. It is especially desirable to use a spring material, such as beryllium copper or nickel beryllium. Using these materials as the conductive contact improves fatigue resistance and heat resistance at high temperatures.

Preferably, the thickness of the contact ranges from 0.01 to 0.10 mm, and more preferably, it ranges from 0.02 to 0.05 mm. This range is preferred because if the thickness is less than 0.01 mm, then the strength of the contact as a cantilever is insufficient, making it difficult to obtain an appropriate contact load. If the thickness exceeds 0.1 mm, then the elasticity range of the materials is exceeded, so that the terminals of a mounted electronic device cannot effect sufficient displacement of the contact to press the contact against an opposed connecting element on the opposite side of the contact sheet, and it may become difficult to secure a stable connection.

For the elastic materials constituting the contact sheets, any material that exhibits resistance to heat and weather is suitable. For example, rubber, such as a silicone rubber or a synthetic rubber, or resin, such as a polymer, a polyimide, or an engineering resin, are available. A polyimide constituent, in particular, is suitably used.

The contact sheets of the present invention can be ideally used as sockets or contact boards for providing an electrical connection between electronic devices having spherical terminals or planar terminals, for example, integrated circuits. To be more specific, the contact sheets can be ideally used when mounting various electronic devices, such as integrated circuits, electronic parts, cables, printed circuit boards, connectors, microphones, motors, antennas, or speakers etc., on a electronic device, for example a mounting board, testing board, etc., having spherical terminals or planar terminals.

In particular, a contact sheet in accordance with the present invention can be suitably used for electronic devices with grid arrays, such as integrated circuits, having terminal pitches ranging from 0.4 to 2.54 mm, where the number of terminals thereof ranges from 500 to 3000. The contact sheet enables reliable electrical connections, even with integrated circuits that have many terminals arranged in a grid pattern for which electrical connections tend to be unstable if some warpage occurs.

Hereafter, the embodiments of applications of the contact sheets in accordance with the present invention are explained with respect to the case where integrated circuits and printed circuit boards are applied as the electronic devices.

Figure 6:
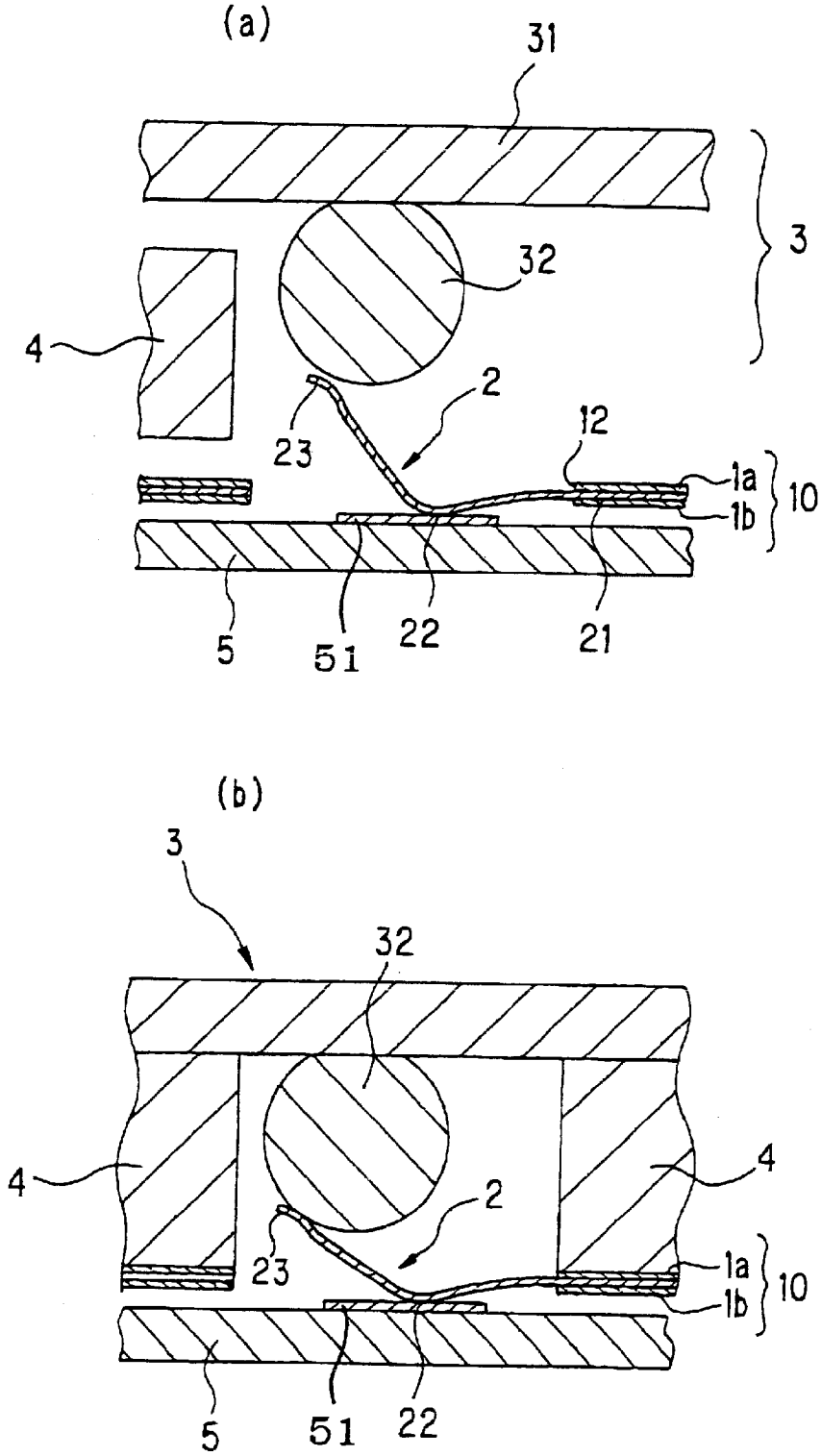
FIGS. 6(*a*) and (*b*) are schematic sectional views showing a mode wherein a contact sheet in accordance with the present invention is applied to an integrated circuit having spherical terminals.

As shown in FIGS. 6(*a*) and 6(*b*), when a BGA integrated circuit 3 having spherical terminals 32, for example solder balls, arranged in a grid pattern on the substrate 31 is mounted on the outer side of the substrate sheet 1*a* of the contact sheet 10 via a spacer 4, a load is applied to the non-fixed end 23 of the contact 2, which is pressed by the spherical terminal 32 of the integrated circuit 3. Consequently, an electrical connection can be ensured between the contact 2 and the integrated circuit 3, and at the same time, an electrical connection can be ensured between the contact 2 and the printed circuit board 5 because the bending portion 22 of the contact 2 is warped by the stress applied to the bending portion 22 and is pressed against the printed circuit board 5, which is positioned at the outer side of substrate sheet 1*b* (FIG. 6(*a*)).

In this case, the bending portion 22 of the contact 2 may be brought into contact with the printed circuit board 5 beforehand. In this way, an even more reliable electrical connection is provided, and the overall reliability can be increased.

Preferably, the bending portion 22 of the contact 2 of the contact sheets 10 of the present invention protrudes downwardly from the outer side of sheet 1*b* of the two substrate sheets 1*a* and 1*b* in order to ensure the reliable electrical connection (See FIG. 6(*a*)).

Furthermore, as shown in FIG. 2, the contact sheets 10 of the present invention enables increased displacement of the non-fixed end 23 when a spherical terminal 32 is mounted, and also improves the resistance to permanent plastic deformation. Moreover, since the contact 2 includes bending portion 22, where the contact 2 is bent at the proper angle, for example 40 to 50 degrees, the non-fixed end 23 can be flexibly positioned against the variation of pushing force by spherical terminal 32, following the vertical deviation of spherical terminal 32, because the displacement of the non-fixed end is smaller. Therefore even if the height of the spherical terminals is uneven or the integrated circuit 3 and/or the printed circuit board 5 are warped, these fluctuations can be compensated for, and the contact sheet ensures the electrical connection between the integrated circuit 3 and printed circuit board 5 (See FIG. 6(*b*)).

Furthermore, since the spherical terminal 32 pushes open the bending portion 22 and contacts the non-fixed end 23 without contacting the bending portion 22, collapse of the surface of the spherical terminal 32 is prevented.

In this case, the inner edges of the V-shaped or U-shaped notch 25 of contact 2 can scratch off the oxide film on spherical terminals 32, and consequently, a more reliable electrical connection can be realized.

Moreover, because the terminal 51 of printed circuit board 5 and the contact 2 are connected by the pushing force exerted when the spherical terminal 32 bends the contact 2, and the bending portion 22 of the contact 2 is set to contact the terminal 51 of the printed circuit board beforehand, it is possible to reduce the distance over which a current passes through the contact 2, and to decrease the inductance for high-frequency clocking, making the contact sheets suitable sockets for various tests or mounting. That is, the contact sheet 10 in accordance with the present invention reduces the distance over which a current passes through the contact 2 to nearly the radius of the spherical terminal 32, which preferably ranges from 0.10 to 0.15 mm.

In addition, since each contact 2 is arranged between the spherical terminal 32 and printed circuit board 5, the length of the contact 2 can be set up as long. Therefore, the displacement can be maximized without exceeding the elastic limit of contact 2, and breakage of the contact 2 can be prevented, and the load applied to the printed circuit board can be reduced.

In the contact sheet 10 in accordance with the present invention, each contact associated with a plurality of respective through-holes 11 may be arranged in a parallel direction with respect to one another so that the non-fixed end 23 of each contact faces the same side edge of each through-hole. Further, pairs of contacts can be arranged so that the non-fixed ends 23 of each adjacent pair of contacts extend in opposite directions to one another in a predetermined pattern. Adopting the latter arrangement makes it possible to better position an integrated circuit 3 having spherical terminals 32 with respect to the contact sheet 10 in the longitudinal direction of the contacts.

Moreover, when the integrated circuit 3 is mounted with the contact sheet 10, the force with which the spherical terminal 32 pushes on the non-fixed end 23 may be larger than the vertical force with which the bending portion 22 pushes on the printed circuit board 5. In this way, the oxide film on spherical terminals 32 can be scratched off effectively, the mounting/dismounting force of the integrated circuit 3 is reduced, the stress applied to the printed circuit board is decreased, and damage to the printed circuit board is prevented. In addition, it is preferable that the surface of the spherical terminals 32 is scratched to a depth ranging from 0.001 to 0.005 mm to effectively eliminate the oxide film.

As mentioned later, to double the displacement of the contact, the contact sheet may be formed as a complex of contact sheets, wherein a plurality of contact sheets are bonded together via an interposed adhesive sheet having through holes formed therethrough in the same pattern as that of the contact sheets, or a complex of contact sheets wherein the contact sheets are bonded via glue or soldering. In the case where the complex of contact sheets comprises contact sheets which are bonded directly via an adhesive sheet, one of the substrate sheets of each of the contact sheets which would otherwise face the interposed adhesive sheet is preferably removed, such that the contacts are directly adhered to the adhesive sheet. In the case where the contact sheets of the complex are bonded directly via glue or soldering, one of the substrate sheets of each of the contact sheets which would otherwise face the glue or soldering is preferably removed, such that the contacts are directly adhered via the glue or solder.

Figure 7:
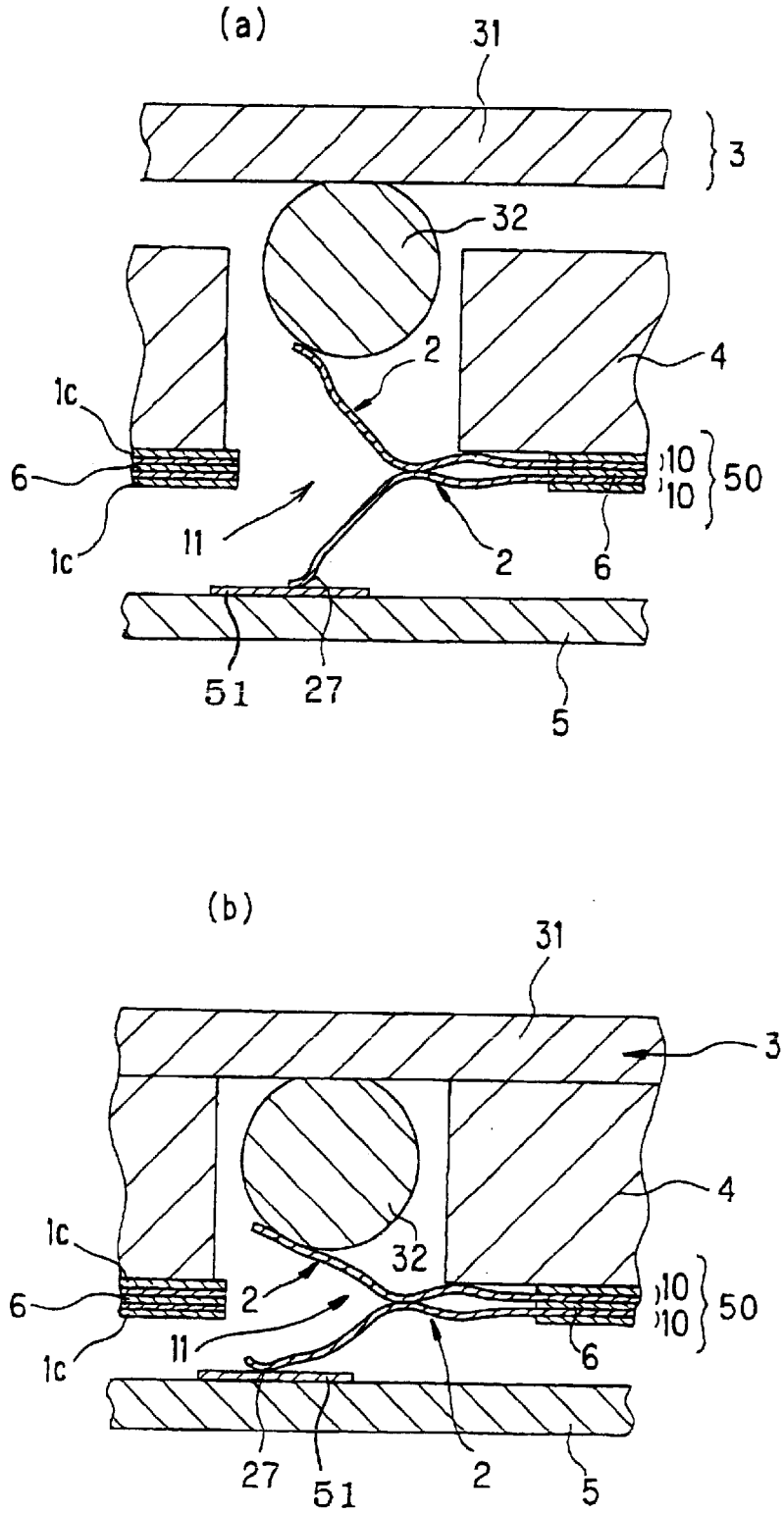
FIGS. 7(*a*) and (*b*) are schematic sectional views showing a mode wherein a complex of the contact sheets in accordance with the present invention is applied to the electronic device having spherical terminals.

Specifically, when an integrated circuit and a printed circuit board are the electronic devices, as shown in FIGS. 7(*a*) and 7(*b*), wherein FIG. 7(*a*) shows a state before mounting and FIG. 7(*b*) shows a state after mounting, the contact sheet 10 is a complex 50 of contact sheets, wherein two contact sheets are bonded together via an adhesive sheet 6 having through holes formed therethrough in the same pattern as that of the through holes 11 in the substrate sheet 1*c*. FIGS. 7(*a*) and (*b*) show the complex 50 of contact sheets with two contacts 2 which are fixed on respective substrate sheets 1*c* and directly bonded via the adhesive sheet 6.

The configuration mentioned above makes it possible to double the displacement compared to the configuration having one contact sheet, even when contacts having the same elasticity are used in both cases. Moreover, since the bending portions of the two contacts 2 contact one another, the electrical connection is provided and reality is increased.

The shapes of the two contacts 2 for the complex 50 of contact sheets are not particularly restricted as long as the aforementioned relation of the width is kept. The shapes of the two contacts may be symmetrical with respect to the center of the adhesive sheet 6, or different independently of each other. The shapes of the contacts 2 in the complex 50 of contact sheets shown in FIGS. 7(*a*) and 7(*b*) are different. In addition, a curved contact portion 27 is formed at the printed circuit board end (non-fixed) of contact 2, which protects the planar terminal 51 of the printed circuit board 5 from being damaged.

In this case, since the contact 2 is fixed to substrate sheet 1*c*, an electrical connection can also be established through the fixed end of the contact. An anisotropic conductive sheet may be employed as the adhesive sheet 6. An anisotropic conductive sheet is a sheet which provides perpendicular electrical conductivity and horizontal insulation, and is made from an adhesive base substance. This structure prevents current leakage, ensures the electrical connection and further increases reliability. Moreover, the fixed parts of the contacts can be metallically bonded to each other by soldering.

Figure 8:
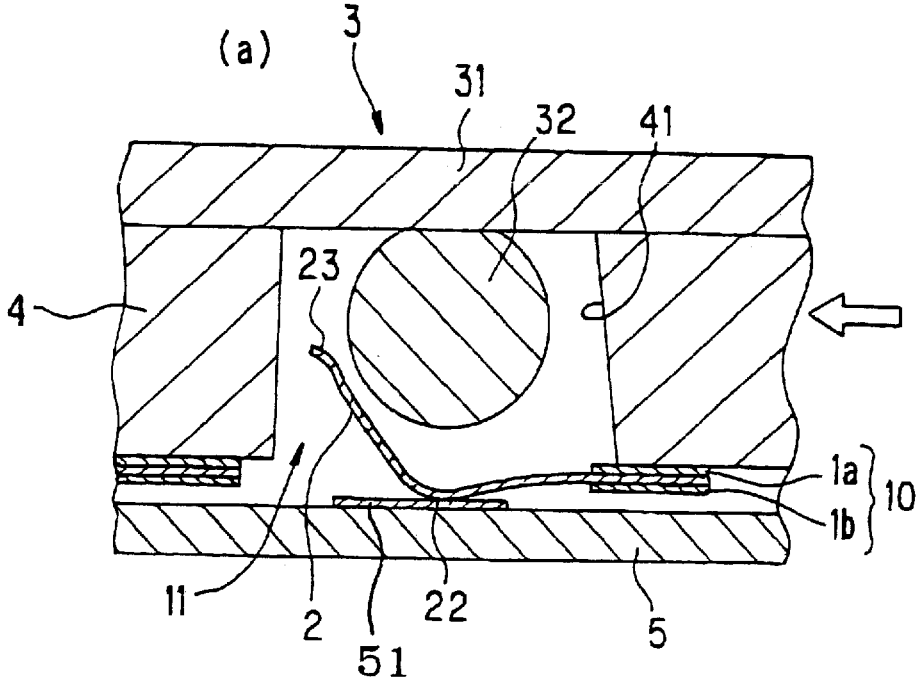
FIGS. 8(*a*) and (*b*) are schematic sectional views showing a mode wherein a contact sheet in accordance with the present invention is applied to a ZIF structure.
Figure 8:
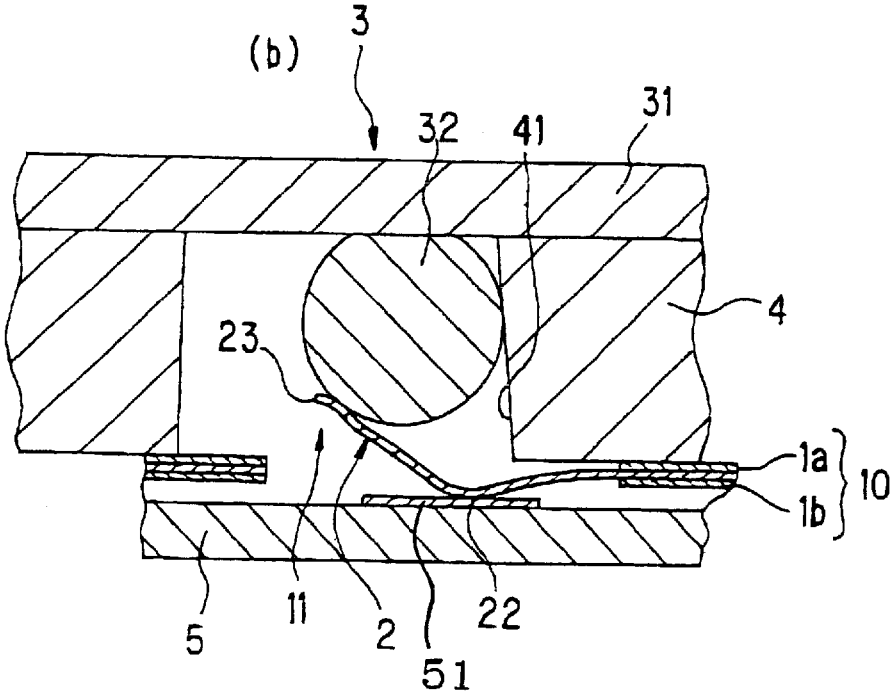

The contact sheet 10 in accordance with the present invention is also suitably used with a socket having a zero insertion force (ZIF) structure, as shown in FIGS. 8(*a*) and (*b*). In the ZIF structure, an electronic device, such as integrated circuit 3, does not shift vertically to the surface of substrate sheet 1*a*. A spacer 4 slides in the direction shown by the arrow (horizontally with respect to the surface of substrate sheet 1*a*) to mount the integrated circuit 3. In this case, the spacer 4 comes into contact with an upper portion of the spherical terminal 32 on the side portion 41, which is formed to have a sloped surface. In this way, the spherical terminal 32 easily slides horizontally to the surface of the substrate sheet. It is not necessary to provide the spacer 4, however.

Hence, in the ZIF structure, using a 10 to 40 $\mu$m thick sheet to form the contact 2 reduces the load of contact with the spherical terminal 32, so that the overall contact resistance can be reduced while the number of contacts is increased.

As terminals of an electronic device which employs the contact sheet in accordance with the present invention, an integrated circuit, a BGA (Ball Grid Array) and a LGA (Land Grid Array) may be suitable, for example. Hereafter, the case where an integrated circuit is used as an electronic device is explained.

Figure 9:
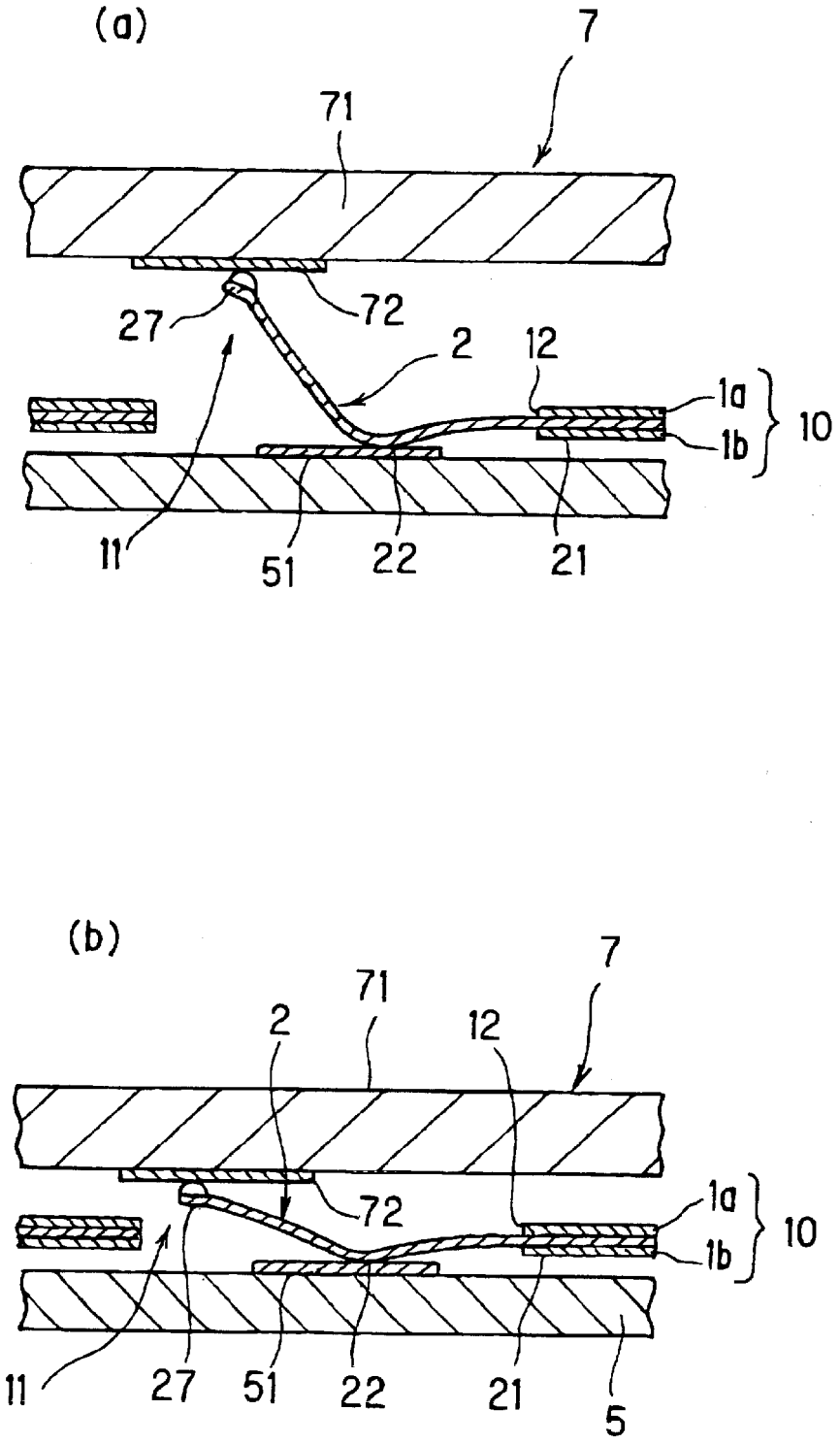
FIGS. 9(*a*) and (*b*) are schematic sectional views showing a mode wherein a contact sheet in accordance with the present invention is applied to an integrated circuit having planar terminals.

As shown in FIG. 9(*a*) and FIG. 9(*b*), when a LGA integrated circuit 7 equipped with the planar terminal 72 on the substrate 71 is mounted on the printed circuit 5, the planar terminal 72 pushes from above onto the contact 2, which has curved contact portions 27 at the non-fixed end. The contact portions 27 of the contact 2 are pushed away from the fixed end 21 of the contact 2, while the bending portion 22 is pushed downwardly toward the terminal 51 of the printed circuit board 5. Consequently, a reliable electrical connection between the integrated circuit 7 and the printed circuit board 5 can be provided.

Figure 10:
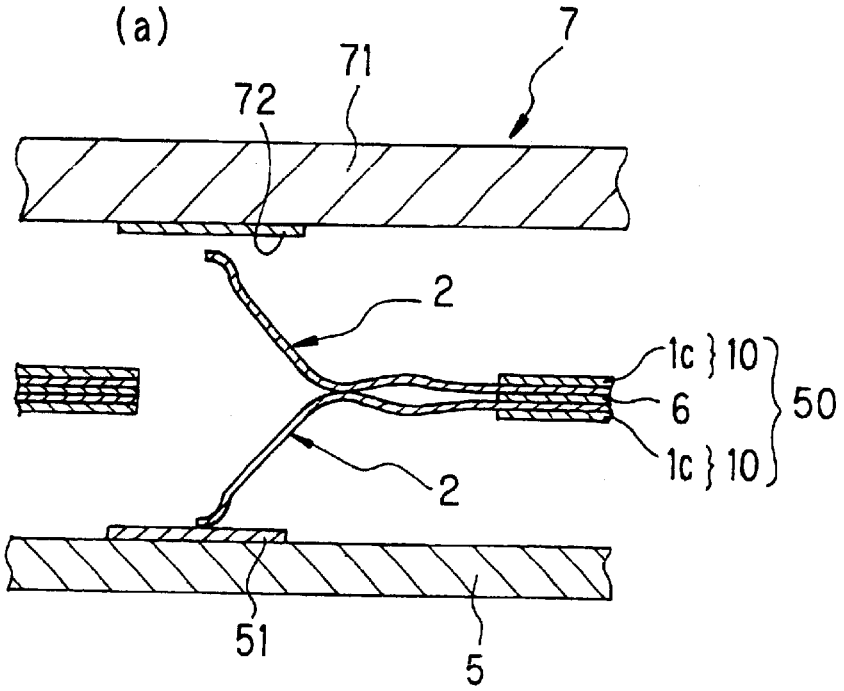
FIGS. 10(*a*) and (*b*) are schematic sectional views showing a mode wherein a complex of contact sheets in accordance with the present invention is applied to an electronic device having planar terminals.
Figure 10:
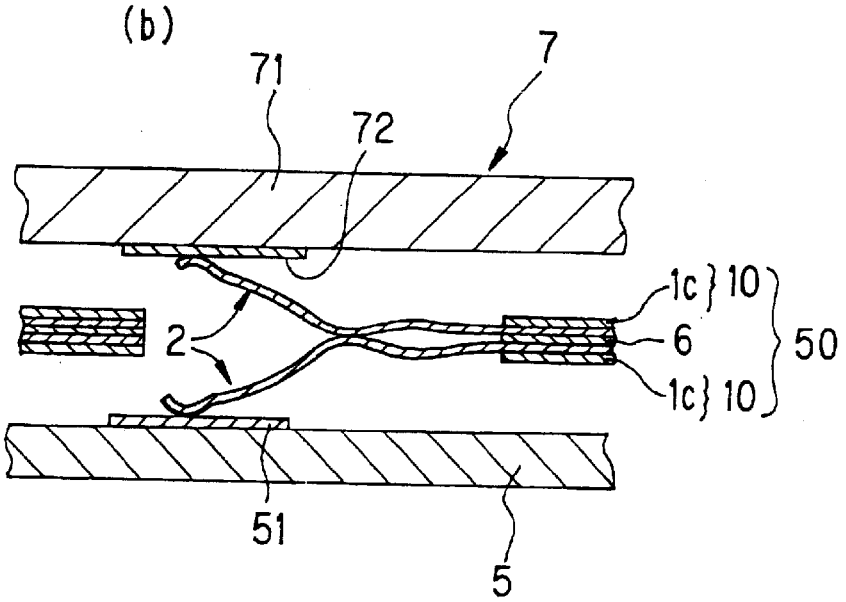

Furthermore as shown in FIGS. 10(*a*) and 10(*b*), wherein FIG. 10(*a*) shows a state before mounting an integrated circuit and FIG. 10(*b*) shows a state after mounting, even with a LGA, two of the contact sheets 10 in accordance with the present invention are bonded together via an adhesive sheet 6 having through holes formed therethrough in the same pattern as that of the contact sheets, to comprise a complex 50. In addition, FIGS. 10(*a*) and 10(*b*) show a complex 50 of the contact sheets, wherein two contacts 2 which are respectively fixed on substrate sheets 1*c* are bonded to each other directly via the adhesive sheet 6.

In this way, even when contacts having the same elasticity are adopted, it is possible to double the contact displacement over that of a single contact sheet, as well as over the case of a BGA. Moreover, by providing a secure contact between the two contacts 2, a secure electrical connection is also provided and the reliability can be increased.

Hereafter, two embodiments of a method for manufacturing the contact sheets in accordance with the present invention are explained.

First Embodiment

First, an insulative elastic substrate sheet having a plurality of through holes formed therethrough is provided and a conductive elastic sheet is bonded thereto. Next, etching is applied to the conductive elastic sheet, leaving sections where contact springs are to be formed. Subsequently, the contact springs are formed by cutting and bent by pressing. In addition, a plating process may be applied before or after pressing, if necessary. Lastly, another insulative elastic substrate sheet having a plurality of through holes formed therethrough is arranged, such that the through holes of the two insulative elastic substrate sheets substantially align.

Second Embodiment

First, etching and pressing are applied to the conductive elastic sheet, making sections where contact springs are to be formed. Next, these sections are inserted and bonded between two insulative elastic substrate sheets having a plurality of through holes formed therethrough, and are then cut and bent by pressing. Still more, the process of cutting and bending by pressing may be applied while the sections where contact springs are to be formed are bonded on the insulative elastic substrate sheet. The plating process also may be applied before or after pressing, if necessary.

A complex of contact sheets can be formed by providing two contact sheets formed by the above method, inserting an adhesive sheet having a plurality of through holes formed therethrough in the same pattern as the through holes of the contact sheets between the contact sheets, and thermo-compression bonding the sheets.

Moreover, adhesive or solder may be applied to the surface of the contact sheets, except the parts of contacts positioned in the through holes, by painting or printing, and thermo-compression bonding or fusion bonding the contact sheets to form a complex.

The contact which is used for the contact sheet in accordance with this invention can be regarded as an application of a cantilever which is fixed at one end of one side (the fixed end 21) and supported at the other end (non-fixed end 23) and has a load point (bending portion 22) located between both ends. In this system, when the shape of the contact beam is rectangular, both the stress and the amount of bending are locally maximized at the fixed end and the bending portion. In contrast, a portion of the contact located midway between the bending portion and the fixed end, as well as the non-fixed end, do not experience any significant bending or stress. If this portion is made as narrow as possible, the contact is bent evenly and with maximum displacement. In FIG. 2, W1 is about half of the pitch of the spherical terminals, and W2 cannot be less than dozens of $\mu$m (e.g., 20–60 $\mu$m) because W2 is a contact point, and W2+W3 is about one third of W1. W4+W5 is preferably about half of W1 according to the results of endurance tests and considering workability, and W6 is almost the same size of W1. Good results were obtained with the above-mentioned sizes.

As explained above, the present invention provides a contact sheet that enables reliable electrical contact between electronic devices under low spring load while accommodating variations in the sizes of electronic devices, such as integrated circuits, cables, and printed circuits. The contact sheet is suitably used for various types of testing equipment or mounting electronic devices, provides excellent durability and reliability over repeated and long-term use, and facilitates a ZIF (zero insertion force) structure for an electronic device with spherical terminals.

What is claimed is:

1. A contact sheet for providing an electrical connection between two or more electronic devices each having spherical or planar terminals, said contact sheet comprising:

a plurality of insulative elastic substrate sheets disposed to form a layered structure having a plurality of through holes formed therethrough in a predetermined pattern; and a plurality of conductive elastic contacts each extending from a first end thereof to an opposed second end thereof to define a longitudinal length dimension therebetween and having a width dimension measured perpendicular to said length;

wherein said first end of each said contact is interposed and fixed between two of said insulative elastic substrate sheets at a fixed point proximate one edge of a respective through hole, and said second end is arranged to bend as a cantilever extending from said fixed point such that said second end departs a predetermined distance from a first surface of said contact sheet with respect to said fixed point when a load is applied to said second end;

each said contact further comprising a bending portion located proximate a midpoint of said length of said contact where said contact is bent to extend in an angular direction such that said second end of said contact is positioned at said distance from said first surface of said contact sheet;

wherein said width of said contact continuously varies to be greater at portions of said contact which are subjected to larger stresses and less at positions of said contact which are subjected to smaller stresses when a load is applied to said second end of said contact;

wherein when a first electronic device is mounted on a first side of said contact sheet, a spherical terminal or a planar terminal of the first electronic device applies a load to said second end of said contact, and said second end of said contact presses against and wipes a surface of the spherical terminal or the planar terminal to secure an electrical connection between said contact and the first electronic device, while said bending portion of said contact is warped by the stress applied thereto and is pressed against a second electronic device mounted at a second side of said contact sheet to secure an electrical connection between said contact and the second electronic device, such that the first and the second electronic devices are electrically connected to each other via said contacts of said contact sheet.

2. A contact sheet according to claim 1, wherein said contact sheet further comprises a second surface opposing said first surface, and said bending portion of said contact protrudes beyond said second surface of said contact.

3. A contact sheet according to claim 1, wherein the electronic devices comprise one or more devices selected from the group consisting of integrated circuits, electronic parts, cables, printed circuit boards, connectors, microphones, motors, antennas, and speakers.

4. A contact sheet according to claim 1, wherein said contacts are arranged in a grid pattern.

5. A contact sheet according to claim 1, wherein said width of said contact is greatest at said bending portion, and decreases gradually to be continuously narrower from said bending portion toward said second end, and said width is narrowest at said second end, and said width decreases gradually to be continuously narrower from said bending portion toward an intermediate portion of said contact between said bending portion and first said end, and increases gradually to be continuously wider from said intermediate portion to said first end.

6. A contact sheet according to claim 1, wherein said contact further comprises a notch opening toward said second end and extends between said second end and a predetermined portion of said contact between said second end and said bending portion.

7. A contact sheet according to claim 1, wherein said contact further comprises a slit formed in the shape of a convex lens positioned between said first end and a predetermined portion of said contact between said first end and said bending portion.

8. A contact sheet according to claim 1, wherein a peripheral edge of said contact has an outline in the shape of a concave lens over a portion of said length extending between said first end and a predetermined portion of said contact between said first end and said bending portion.

9. A contact sheet according to claim 1, wherein said first end of said contact is wider than said bending portion and a portion of said first end extends back toward said second end.

10. A contact sheet according to claim 9, wherein said portion of said first end extends back toward said second end to a position proximate a midpoint of said length of said contact.

11. A contact sheet according to claim 1, wherein said second end of said contact comprises two cantilevers, each of said cantilevers having a protrusion which is bent at an angle in a range of 20 to 90 degrees toward a planar terminal of one of the electronic devices facing said cantilevers, and wherein an outer edge of said protrusion wipes the surface of the planar terminal of the electronic device such that said contact and the electronic device are securely electrically connected at a position where the contact resistance between said contact and the electronic devices is reduced.

12. A contact sheet according to claim 1, wherein said bending portion of said contact comprises at least one bump protruding toward one of the electronic devices and positioned proximate a position where the electronic device contacts said bending portion, such that an outer edge of said at least one bump presses the electronic device to securely electrically connect said contact and the electronic device at a position where the contact resistance between said contact and the electronic device is reduced.

13. A contact sheet according to claim 1, wherein said length of said contact is sufficient to increase the amount of bending displacement of said second end as a cantilever extending from said fixed point when a load is applied to said second end of said contact.

14. A contact sheet according to claim 1, wherein said contact is shaped to effectively increase the amount of bending from said first end to said bending portion and reduce the amount of bending from said bending portion to said second end when a load is applied to said second end of said contact as a cantilever extending from said fixed point.

15. A complex of contact sheets for providing an electrical connection between two or more electronic devices each having spherical or planar terminals, said complex comprising:

at least a first and a second contact sheet, each of said first and said second contact sheets comprising a plurality of insulative elastic substrate sheets disposed to form a layered structure having a plurality of through holes formed therethrough in a predetermined pattern, and a plurality of conductive elastic contacts each extending from a first end thereof to an opposed second end thereof to define a longitudinal length dimension therebetween and having a width dimension measured perpendicular to said length, wherein said first end of each said contact is fixed to at least one of said insulative elastic substrate sheets at a fixed point proximate one edge of a respective through hole, and said second end is arranged to bend as a cantilever extended from said fixed point such that said second end departs a predetermined distance from a first surface of said contact sheet with respect to said fixed point when a load is applied to said second end, each said contact further comprising a bending portion located proximate a midpoint of said length of said contact where said contact is bent to extend in an angular direction such that said second end of said contact is positioned at said distance from said first surface of said contact sheet, wherein said width of said contact continuously varies to be greater at portions of said contact which are subjected to larger stresses and less at positions of said contact which are subjected to smaller stresses when a load is applied to said second end of said contact; and an adhesive sheet having a plurality of through holes formed therethrough in the same pattern as said predetermined pattern of each of said first and said second contact sheets, said adhesive sheet being interposed between a second surface of said first contact sheet and a second surface of said second contact sheet to bond said first and said contact sheets to one another, and said first and said second contact sheets are disposed as a layered structure such that said patterns of said through holes of each of said first and said second contact sheets substantially align and said contacts of said first contact sheet substantially face said contacts of said second contact sheet;

wherein when a first electronic device is mounted on a first side of said first contact sheet, a spherical terminal or a planar terminal of the first electronic device applies a load to said second end of said contact of said first contact sheet, and said second end of said contact of said first contact sheet presses against and wipes a surface of the spherical terminal or the planar terminal to secure an electrical connection between said contact of said first contact sheet and the first electronic device, while said bending portion of said contact of said first contact sheet is warped by the stress applied thereto and is pressed against a bending portion of a contact of said second contact sheet facing said contact of said first contact sheet to provide an electrical connection between said contact of said first contact sheet and said contact of said second contact sheet, and when a second electronic device is mounted on a first side of said second contact sheet, a spherical terminal or a planar terminal of the second electronic device applies a load to said second end of said contact of said second contact sheet, and said second end of said contact of said second contact sheet presses against and wipes a surface of the spherical terminal or the planar terminal to secure an electrical connection between said contact of said second contact sheet and the second electronic device;

whereby the first and the second electronic devices are securely electrically connected to each other via said contacts of said first and said second contact sheets of said complex.

16. A complex of contact sheets according to claim 15, wherein said adhesive sheet is directly adhered to said contacts of said first and said second contact sheets.

17. A complex of contact sheets according to claims 16, wherein said adhesive sheet is an anisotropic conductive film.

18. A complex of contact sheets for providing an electrical connection between two or more electronic devices each having spherical or planar terminals, said complex comprising:

at least a first and a second contact sheet, each of said first and said second contact sheets comprising a plurality of insulative elastic substrate sheets disposed to form a layered structure having a plurality of through holes formed therethrough in a predetermined pattern, and a plurality of conductive elastic contacts each extending from a first end thereof to an opposed second end thereof to define a longitudinal length dimension therebetween and having a width dimension measured perpendicular to said length, wherein said first end of each said contact is fixed to at least one of said insulative elastic substrate sheets at a fixed point proximate one edge of a respective through hole, and said second end is arranged to bend as a cantilever extended from said fixed point such that said second end departs a predetermined distance from a first surface of said contact sheet with respect to said fixed point when a load is applied to said second end, each said contact further comprising a bending portion located proximate a midpoint of said length of said contact where said contact is bent to extend in an angular direction such that said second end of said contact is positioned at said distance from said first surface of said contact sheet, wherein said width of said contact continuously varies to be greater at portions of said contact which are subjected to larger stresses and less at positions of said contact which are subjected to smaller stresses when a load is applied to said second end of said contact; and an adhesive interposed between a second side of said first contact sheet and a second side of said second contact sheet to bond said first and said contact sheets to one another such that said first and said second contact sheets are disposed as a layered structure and the patterns of said through holes of each of said first and said second contact sheets substantially align and said contacts of said first contact sheet substantially face said contacts of said second contact sheet;

wherein when a first electronic device is mounted on a first side of said first contact sheet, a spherical terminal or a planar terminal of the first electronic device applies a load to said second end of said contact of said first contact sheet, and said second end of said contact of said first contact sheet presses against and wipes a surface of the spherical terminal or the planar terminal to secure an electrical connection between said contact of said first contact sheet and the first electronic device, while said bending portion of said contact of said first contact sheet is warped by the stress applied thereto and is pressed against a bending portion of said contact of said second contact sheet facing said contact of said first contact sheet to provide an electrical connection between said contact of said first contact sheet and said contact of said second contact sheet, and when a second electronic device is mounted on a first side of said second contact sheet, a spherical terminal or a planar terminal of the second electronic device applies a load to said second end of said contact of said second contact sheet, and said second end of said contact of said second contact sheet presses against and wipes a surface of the spherical terminal or the planar terminal to secure an electrical connection between said contact of said second contact sheet and the second electronic device;

whereby the first and the second electronic devices are securely electrically connected to each other via said contacts of said first and said second contact sheets of said complex.

19. A complex of contacts sheet according to claim 18, wherein said contacts of said first and said second contact sheets are directly adhered to one another via said adhesive.

20. A complex of contacts sheet according to claim 19, wherein said adhesive comprises solder.

21. A complex of contacts sheet according to claim 18, wherein said adhesive comprises glue.

* * * * *